US007178792B2

(12) United States Patent
Monahan et al.

(10) Patent No.: US 7,178,792 B2
(45) Date of Patent: Feb. 20, 2007

(54) CHILD SAFETY BARRIERS

(75) Inventors: Robert D. Monahan, Canton, MA (US); Ronald J. Sidman, Marston Mills, MA (US); Jon R. Rossman, Chelmsford, MA (US); Bryan R. Hotaling, Arlington, MA (US); Thomas A. Hagerty, Somerville, MA (US)

(73) Assignee: The First Years Inc., Avon, MA (US)

( * ) Notice: Subject to any disclaimer, the term of this patent is extended or adjusted under 35 U.S.C. 154(b) by 501 days.

(21) Appl. No.: 10/126,304

(22) Filed: Apr. 19, 2002

(65) Prior Publication Data

US 2003/0197164 A1 Oct. 23, 2003

(51) Int. Cl.
*E06B 11/02* (2006.01)

(52) U.S. Cl. ..... 256/73; 160/10; 160/300

(58) Field of Classification Search ..... 254/1, 254/24; 256/73, 1, 24; 160/300, 301, 302, 160/290.1, 10, 7
See application file for complete search history.

(56) References Cited

U.S. PATENT DOCUMENTS

| | | | | |
|---|---|---|---|---|
| 612,166 | A | 11/1898 | Lefort | |
| 708,441 | A | 9/1902 | Williams et al. | |
| 1,215,462 | A | 2/1917 | Agee et al. | |
| 1,217,210 | A | 2/1917 | Packer | |
| 1,756,030 | A | 4/1930 | Kownatzky | |
| 1,778,404 | A | 10/1930 | Stone | |
| 1,902,949 | A | 3/1933 | Condon | |
| 1,996,108 | A | 4/1935 | Herr | |
| 2,194,871 | A | 3/1940 | Pracchia | |
| 2,354,169 | A | 7/1944 | Fredholm | |
| 2,484,984 | A | 10/1949 | Davis | |
| 2,812,020 | A | 11/1957 | Wachtendorff | |
| 3,000,063 | A | 9/1961 | Hoog | |
| 3,163,205 | A | 12/1964 | Gottlieb | |
| 3,216,482 | A | 11/1965 | Lindholm | |
| 3,893,723 | A | 7/1975 | Boule | |
| 3,965,960 | A | 6/1976 | Massey | |
| 4,202,130 | A * | 5/1980 | Smith | 446/7 |
| 4,272,922 | A | 6/1981 | Prager | |
| 4,277,913 | A | 7/1981 | Castle | |
| 4,380,327 | A | 4/1983 | Fish | |
| 4,381,626 | A | 5/1983 | Courtis et al. | |
| 4,470,221 | A | 9/1984 | Courtis | |

(Continued)

FOREIGN PATENT DOCUMENTS

| | | |
|---|---|---|
| CH | 69303 | 6/1915 |

(Continued)

OTHER PUBLICATIONS evenflo; Simple Touch Swing, Owners Manual, #0572070, Nov. 2000. pp. 1-12 and selected pages.

*Primary Examiner*—James R. Brittain
(74) *Attorney, Agent, or Firm*—Michael Best & Friedrich LLP

(57) ABSTRACT

A child safety gate includes a flexible barrier that is retractable into a housing and extendable across a passageway to inhibit passage by a child. An electrically operable extension lock solenoid inhibits barrier extension until activated by a parent. The gate includes a motion sensor, a night light, a child monitor and an interactive audio-visual display.

37 Claims, 9 Drawing Sheets

U.S. PATENT DOCUMENTS 4,506,477 A 3/1985 Castle
4,583,715 A 4/1986 Wright
4,607,455 A 8/1986 Bluem et al.
4,640,034 A * 2/1987 Zisholtz ..... 40/455
4,685,247 A 8/1987 Alam
4,787,174 A * 11/1988 Brown ..... 49/55
4,852,194 A 8/1989 Langan
5,020,834 A 6/1991 Zilkha
5,052,461 A 10/1991 Stern
5,090,468 A 2/1992 Tedeschi
5,102,103 A 4/1992 Putnam
5,152,508 A 10/1992 Fish
5,168,584 A 12/1992 Peebles
5,233,710 A 8/1993 Bernard
5,271,449 A 12/1993 Herrick
5,299,782 A 4/1994 Lambert
5,437,115 A 8/1995 Freese et al.
5,437,134 A 8/1995 Donnelly
5,505,244 A 4/1996 Thumann
5,531,258 A 7/1996 Poulson et al.
5,533,715 A 7/1996 Dandrea
5,553,833 A 9/1996 Bohen
5,570,543 A 11/1996 Bishop
5,617,674 A 4/1997 Terrill
5,636,679 A 6/1997 Miller et al.
5,638,885 A 6/1997 Freese et al.
5,657,809 A 8/1997 Longoria et al.
5,690,317 A * 11/1997 Sandsborg ..... 256/1
5,704,164 A 1/1998 Huang
5,709,349 A 1/1998 De Chevron Villette et al.
5,782,039 A 7/1998 Scherer et al.
5,797,218 A 8/1998 Holland
5,829,505 A 11/1998 Brescia
5,906,068 A 5/1999 Bode
5,924,242 A 7/1999 Macari et al.
5,927,011 A 7/1999 Sickenius
5,943,832 A 8/1999 Russell
6,056,038 A 5/2000 Foster et al.
6,079,157 A * 6/2000 Hincher, Sr. ..... 49/57
6,114,963 A * 9/2000 Blake et al. ..... 340/573.4
6,116,983 A * 9/2000 Long et al. ..... 446/227
6,149,489 A * 11/2000 Johnson ..... 446/227
6,244,324 B1 6/2001 Quates et al.
6,375,165 B1 * 4/2002 Sherratt et al. ..... 256/24
6,536,502 B2 * 3/2003 Britto et al. ..... 160/23.1
6,557,611 B1 * 5/2003 Fuentes ..... 160/10
6,592,425 B2 * 7/2003 Bapst et al. ..... 446/227
6,759,961 B2 * 7/2004 Fitzgerald et al. ..... 340/573.1
6,769,588 B2 * 8/2004 Zheng ..... 224/576
2001/0015266 A1 8/2001 Yates et al.
2001/0038522 A1 * 11/2001 Zheng ..... 361/680
2002/0194786 A1 * 12/2002 Hincher, Sr. ..... 49/463

FOREIGN PATENT DOCUMENTS

CH 236549 7/1945
DK 4567 2/1902
EP 0018864 11/1980
GB 2129473 A 5/1984
GB 2352219 A * 1/2001
WO WO 91/16519 10/1991
WO WO 93/12317 6/1993
WO WO 9966164 A1 * 12/1999

* cited by examiner

CHILD SAFETY BARRIERS

BACKGROUND

The invention relates to child safety barriers, such as are placed across doorways to protect children.

Safety gates are found in interior doorways and passages in the homes of many people with infants or small children. Some such gates are rigidly mounted to one side of a passage and can swing open. Others, for example, are secured by pressure between opposing vertical surfaces, and removed entirely to allow passage. Improvements in manufacturability, ease of use, and safety are desired for such gates.

In one aspect, the invention features an adjustable width child safety gate. The gate includes a housing mountable to a surface on one side of a passageway and a main shaft coupled to the housing for rotation about an axis. The gate also includes a flexible barrier secured to the main shaft at an inner edge of the barrier. The barrier is extendable across the passageway to inhibit passage by a child. The gate also includes an electrically operable extension lock adapted to prevent extension of the barrier from the housing until electrically unlocked.

Various embodiments have one or more of the following features. The lock permits retraction when locked. The gate includes a barrier stop member coupled to the main shaft and arranged to prevent rotation of the main shaft when locked. The gate includes an electric switch operable to unlock the extension lock. The switch is disposed at a distal end of the flexible barrier. The lock includes a solenoid biased toward a locking position. The lock is disposed within the housing. The lock includes a pawl biased to inhibit rotation of the shaft, and retractable to permit shaft rotation. The gate includes a motion sensor located on the exterior of the device. The motion sensor is responsive to motion only above a predetermined height relative to the device. The gate includes an audible alarm triggered by the motion sensor. The gate includes a radio transmitter triggered by the motion sensor. The gate includes a microphone that releases the lock in response to a recognized verbal command.

The gate includes an intercom disposed on the housing. The gate has a light sensor electrically connected to a light. The gate includes a built in audio device. The gate includes a built in video device. The gate includes a cartoon character depicted on the exterior surface of the barrier. The barrier includes multiple light emitting diodes (LEDs) on the exterior surface of the barrier and a sensor electrically connected to the multiple sensors. The multiple LEDs illuminate when triggered by the sensor. The gate includes a noise generating device electrically connected to the sensor.

In another aspect, the invention features a method of selectively blocking a passageway to inhibit passage by a child. The method includes attaching a barrier housing to a structural element on one side of the passageway. The barrier housing contains a retractable barrier extendable across the passageway. The method also includes manually operating an electrical switch to release a barrier extension lock; extending the barrier a desired distance from the barrier housing with the extension lock released; releasably securing a distal end of the barrier to an opposite side of the passageway; and releasing the electrical switch to engage the barrier extension lock to inhibit further extension of the barrier.

Various embodiments include one or more of the following features. The switch is released after the distal end of the barrier is secured to the opposite side of the passageway. The switch is disposed adjacent the distal end of the barrier.

Operating the switch includes depressing a lock release trigger. The trigger is mechanically coupled to a latch at the distal end of the barrier for releasably securing the barrier to the opposite side of the passageway, such that operating the trigger operates both the switch and the latch. The method includes operating the trigger to release both the lock and the latch, and then retracting the barrier into the housing.

In another aspect the invention features a child safety gate that is releasably securable across a passageway to form a barrier of height sufficient to block passage of young children. The gate includes an interactive visual display that has a light electrically connected to a power source and positioned on the barrier and a sensor electrically connected to the light.

Various embodiments have one or more of the following features. The gate includes a housing mountable to a surface on one side of the passageway; a main shaft coupled to the housing for rotation about an axis; a flexible barrier, which extends across the passageway to inhibit passage by the child and is secured to the main shaft at an inner edge of the barrier; and an electrically operable extension lock adapted to prevent extension of the barrier from the housing until electrically unlocked. The lock permits retraction when locked. The gate includes a barrier stop member coupled to the main shaft and arranged to prevent rotation of the main shaft when locked. The gate includes an electric switch operable to unlock the extension lock. The switch is disposed at a distal end of the flexible barrier. The lock includes a solenoid biased toward a locking position. The lock is disposed within the housing. The power source includes a battery enclosed within the gate. The power source includes a cord to plug into a wall outlet. The sensor is responsive to a sound of the child. The sensor is responsive to a touch of the child. The sensor is responsive to a movement of the child. The gate includes a sound device that is connected to the sensor and produces sound when engaged by the sensor.

According to another aspect of the invention, a child safety gate has an interactive display on at least one side of the gate, at a level to be visible and responsive to a child standing adjacent the gate. The gate can have a retractable, flexible barrier with the display mounted on, or incorporated in, a surface of the barrier, for example. Preferably, such a display will include both child-activatable switches and either audible or visual feedback to activation of such switches.

According to another aspect of the invention, a retractable window shade assembly includes a flexible shade rolled about a main shaft. The assembly also includes a retraction release latch and a spring connected to the main shaft to recoil the barrier about the shaft when the release latch is released with the barrier in an extended position. The release latch includes an electrically activatable solenoid that, when energized, releases the latch. A switch disposed near a distal end of the shade is manually operable by a user, with the shade in its extended position, to release the latch for shade retraction. In some cases, the solenoid is powered by batteries contained within the shade assembly. In some other cases, the shade assembly is wired into an AC power source, such as a wall circuit of a residence in which the shade is installed.

Various aspects of the invention can provide advantages in the function and convenience of barrier devices and retractable structures. For example, in the context of retractable child safety gates the inclusion of an electrically-powered lock release can provide a reliable means of inhibiting unintended barrier extension. Electrically powered status indicators, such as lights, are useful for clearly signaling the status of the latch mechanism and the extension release mechanism. Motion and proximity sensor integration with a child safety gate provides particular advantage, enabling the gate to respond to the presence of a child, for example. A gate with child-monitoring capability can assist a remote adult in monitoring children confined by the gate. Furthermore, interactive displays and sensors can help to entertain a child blocked or confined by a barrier gate, particularly as children discontent with being confined will tend to gravitate toward the gate and can there be distracted as well as mentally stimulated by such displays. Other advantages and features will be apparent from the following drawing description and claims.

DESCRIPTION

Figure 1:
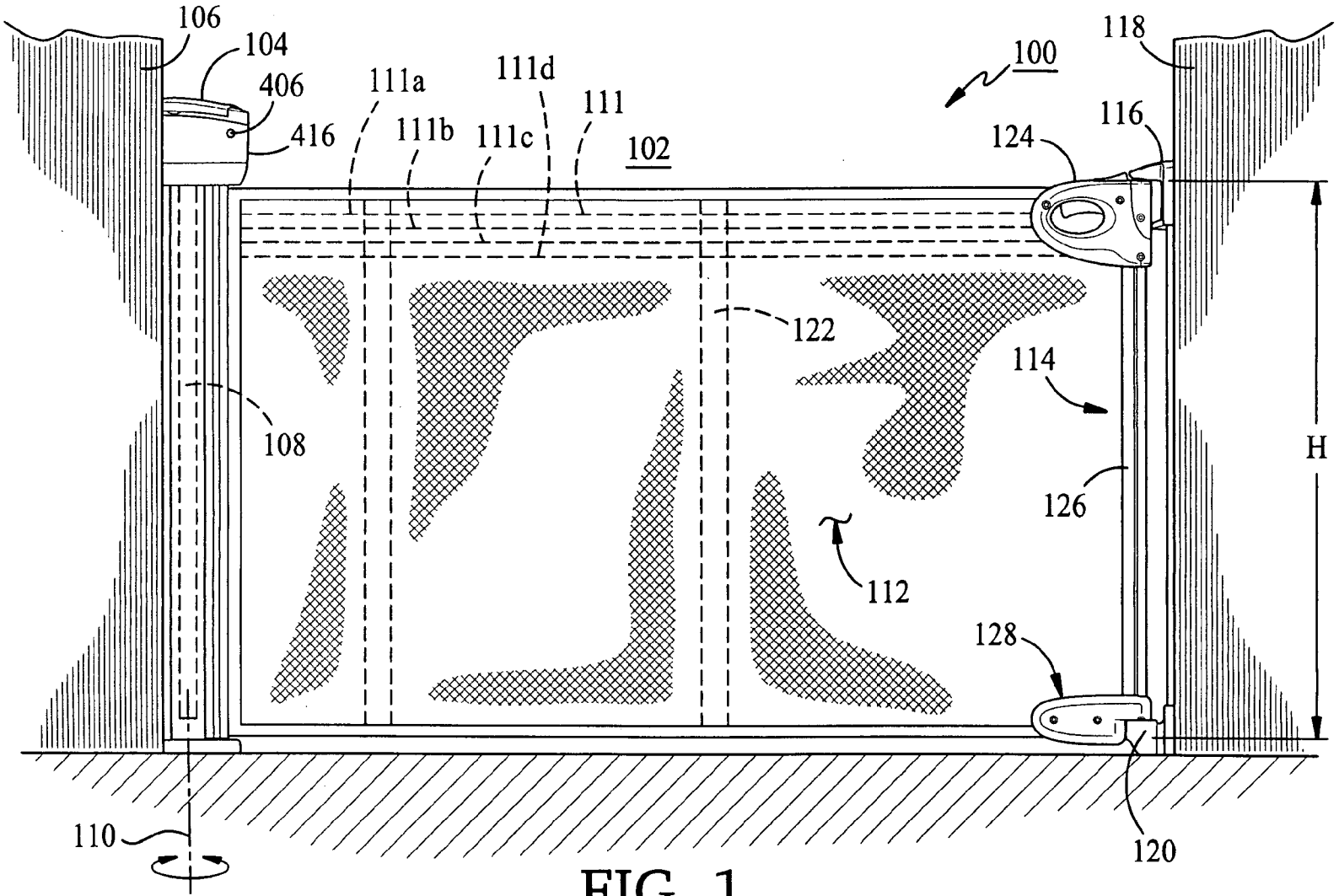
FIG. 1 is a side view of a safety gate mounted in a doorway.
Figure 4:
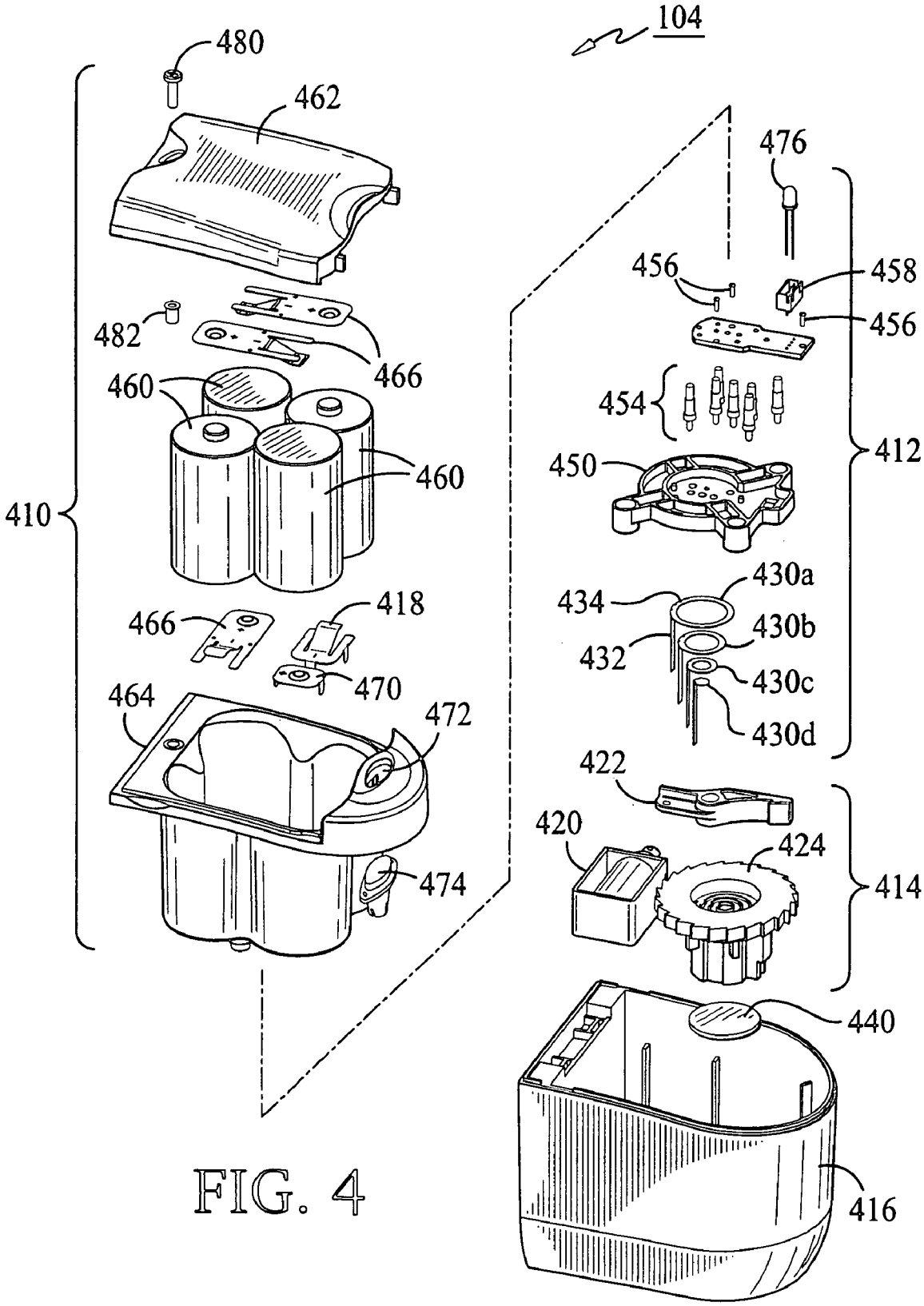
FIG. 4 is an exploded view of the extension release assembly of the gate.

FIG. 1 illustrates an electric adjustable width child safety barrier assembly 100 installed in a passageway 102. The barrier assembly 100 includes a roller housing 104 mounted to a structural element 106 on one side of the passageway 102, a flexible barrier 112 that can be extended across the passageway 102 to prevent the passage of a child, and a latching assembly 114 attached to an edge of barrier 112 that can be releasably secured to an upper receptacle 116 and a lower receptacle 120, mounted to an opposite structural element 106, when barrier 112 is extended across the width of the passageway 102 as shown. A barrier spool shaft 108 is secured to rotate about an axis 110 within housing 104. Barrier 112 is securely attached at one end to spool shaft 108 so that spool shaft 108 rotates as barrier 112 is either extended or retracted. As will be explained below, housing 104 contains a barrier extension release assembly with a solenoid 420 (FIG. 4) that is used to lock the rotation of spool shaft 108 and thereby prevent the barrier from being further extended until an electrical switch within the upper latch assembly 124 is mechanically closed. Solenoid 420 and the electrical switch are connected via a four-conductor cable 111 extending along barrier 112. As will be further explained below, electrical cable 111 includes a ground line 111*a*, a six-volt line 111*b*, a trigger line 111*c* and a low-battery line 111*d*.

The free end of barrier 112 is equipped with an upper latch assembly 124, a lower latch assembly 128, and a rod 126 connecting the upper and lower latch assemblies. Upper receptacle 116 and lower receptacle 120 can be portions of a single receptacle strip mounted to a structural element 118, and are spaced apart a distance corresponding to the distance between the upper and lower latch assemblies 124, 128.

Barrier 112 can be, for example, a polyester mesh cloth, preferably not including holes larger than approximately 1 square inch. Barrier 112 is semitransparent in that there is sufficient hole density to the mesh that a child is able to see through the gate. Alternatively, a transparent film can be employed. In some embodiments, one or more vertical reinforcement strips or rods 122 are attached to the cloth barrier 112, for example, by using heat sealing techniques to enhance the structural integrity of the barrier 112. These rods 122 may be manufactured, for example, from fiberglass or plastic extrusion. The height "H" of barrier 112, measured in a direction perpendicular to the direction of barrier extension, may range from about one to four feet (30 to 183 cm) but is typically about 28 inches (71 cm). The fully extended width of the barrier can be between about 12 and 72 inches (61 to 130 cm) or, more preferably, between approximately 24 and 51 inches (61 cm to 130 cm). Spool shaft 108 is preferably be spring loaded so that barrier 112 tends to automatically retract into housing 104 when unlatched, in the absence of any applied forces.

Figure 2:
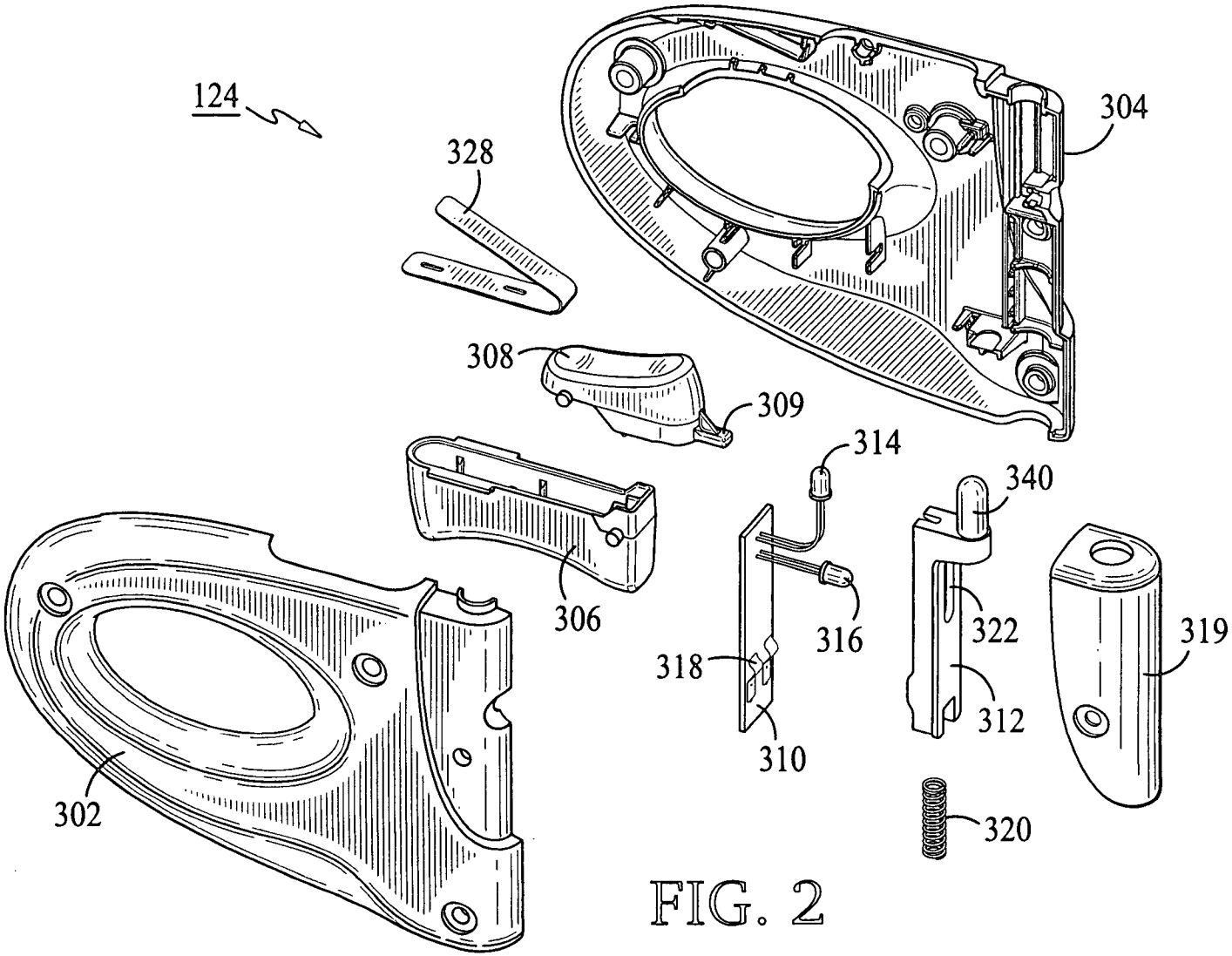
FIG. 2 is an exploded view of the upper latch assembly of the gate.
Figure 3:
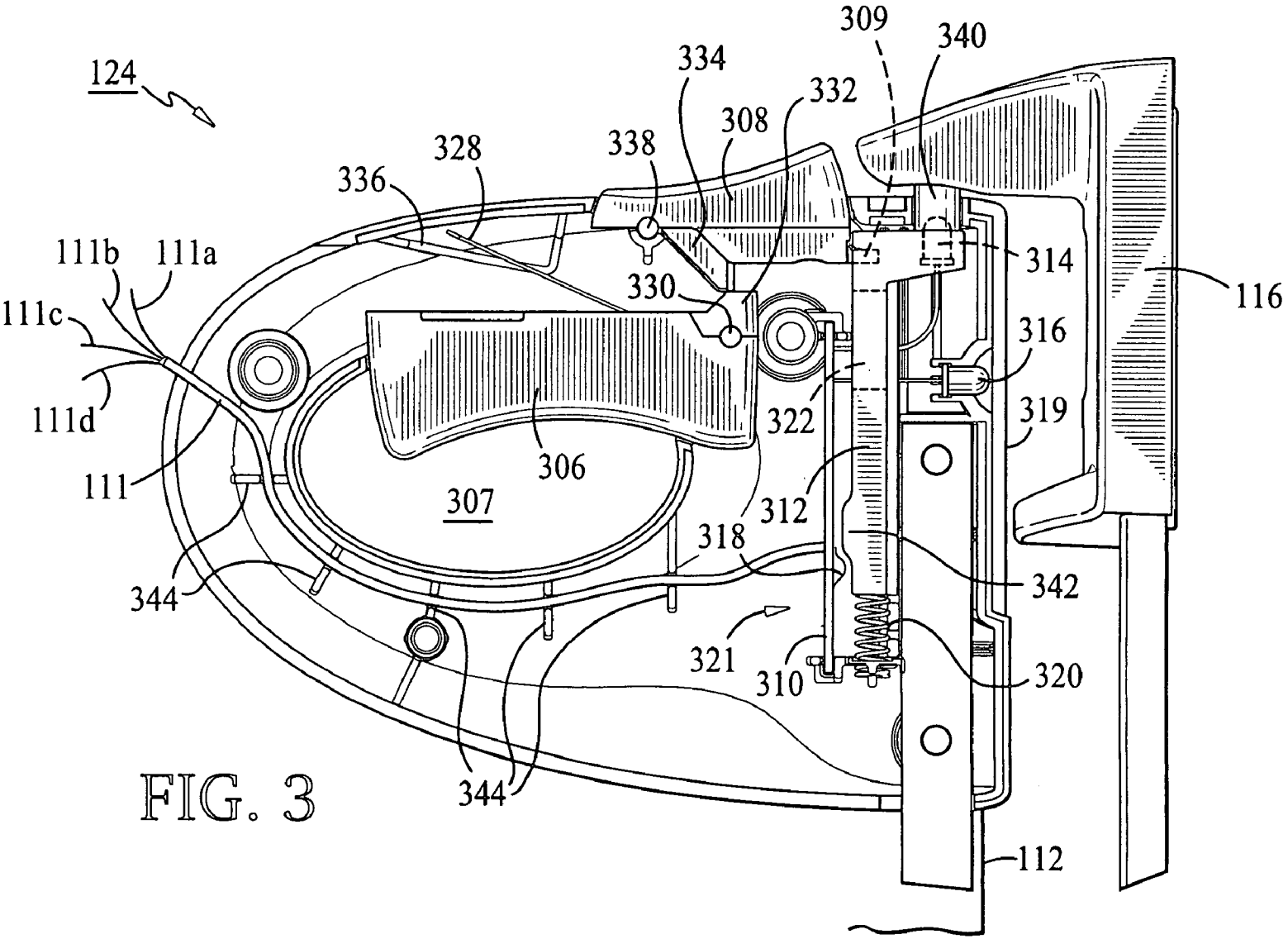
FIG. 3 is a partial cutaway view of the upper latch assembly engaged with the upper receptacle.

Referring to FIGS. 2 and 3, upper latch assembly 124 includes a split housing 302, 304, a manually operable trigger 306, extending into a trigger opening 307 within the housing, a manually operable button 308 exposed on an upper surface of the housing, a printed circuit board (PCB) 310, and a plunger 312. Plunger 312 is biased upward by a spring 320, and is displaced downward by a projection 309 of button 308 when the button is depressed. Plunger 312 has a projection 340 that is received by upper receptacle 116 to secure barrier 112 until released by button operation. Both, a two-color light emitting diode (LED) 314 and a one-color LED 316 extend from PCB 310. Two-color color LED 314 and one-color LED 316 pass through an aperture 322 of plunger 312.

Upper latch assembly 124 is released only by two separate actions (a first action and a second action), in order to inhibit operation by young children. At rest, trigger 306 is biased downward by a torsional wire spring 328. Trigger 306 is depressed upward by the operator in a first action, and rotating trigger 306 about a trigger pin 330 until it reaches a trigger stop 336. As trigger 306 rotates upward, an upwardly projecting rib 332 of the trigger 306 moves forward away from a downwardly projecting flange 334 of button 308. When button flange 334 is no longer in contact with rib 332, the operator is able to depress the button 308 downward in a second action, rotating button 308 about a pin 338 and pushing the plunger 312 downward, disengaging plunger projection 340 from the upper receptacle 116 to release the barrier for retraction.

When the plunger 312 is pushed downward in the second operator action, a flange 342 of plunger 312 pushes resilient contacts 318 against conductive pads on PCB 310 to complete an electrical circuit, functioning as an operable electrical switch 321. As will be further explained below, once the circuit is complete a trigger signal is transmitted to the solenoid at the spool end of the barrier via the trigger line 111*c* of the four-line wire 111. With the circuit made, the one-color LED 316 illuminates a blue light to help guide the operator in latching the gate in low light conditions. At the same time, two-color LED 314 illuminates a red light to indicate the plunger is being pulled down. When plunger 312 subsequently moves up to its fully extended position, flange 342 of plunger 312 disengages with contacts 318 and two-color LED 314 illuminates green light indicating that the plunger is its fully extended position. Once illuminated, LEDs 314 and 316 will remain active for a specified period of time, such as five minutes before turning-off. A timer on PCB 310 de-activates the LEDS when such time has expired.

Power is supplied to PCB 310 via ground line 111*a* and 6 Volt line 111*b*. When switch 321 is closed, PCB 310 applies voltage to trigger line 111*c*. When battery voltage drops below a predetermined threshold, PCB 310 applies voltage to low-battery level line 111*d*. Housing halves 302, 304 sandwich barrier 112 to secure the upper latch assembly to the barrier. in place. Cable 111 within barrier 112 is guided along ribs 344 to PCB 310.

Referring to FIGS. 4-7, the upper end of roller housing 104 includes a mechanical assembly 414, an electrical assembly 412 and a battery pack 410 all housed within a housing 416. The mechanical assembly 414 includes an electrically operated solenoid 420 with a shaft pinned to a pawl 422. Pawl 422 pivots about a boss 426, to engage a toothed extension release gear 424 when engaged by the shaft of solenoid 420 is in its normal, extended position. The gear 424 contains four concentric rings 426 within the center of gear 424. The solenoid remains in a locked position until electrically activated. In other embodiments, the solenoid remains locked while electrically activated and unlocked without electrical activation. Suitable solenoids include TS0-0837, available from Tai-Shing Electronic Components Corporation of Taipei, Taiwan.

Electrical assembly 412 contains four ring contacts 430*a*, 430*b*, 430*c*, and 430*d* that are secured into the concentric 5 recessed between raised ribs 426 of gear 424 and correspond to the lines of cable 111. Each ring contact 430 has a bottom portion 432 that extend through gear 424 and is soldered into a PCB board 440 mounted in the underside of the gear. The ring contacts make electrical contact with a stationary PCB 452 through seven spring-loaded pins 454 (e.g., pin 454*a*, pin 454*b*, pin 454*c*, pin 454*d*, pin 454*e*, pin 454*f*, and pin 454*g*). PCB 452 is secured to a contact housing 450 by three screws 456, contact housing 450 secured within housing 416, in turn, by battery housing 464.

A 4-pin connector 458 mounted to the top of PCB 452 connects the four electrical lines to stationary electrical components. Ground line 111*a* and 6V line 111*b* are connected to battery pack 410. Trigger line 111*c* is connected to solenoid 420, and low voltage line 111*d* is connected to an LED 476.

Battery pack 410 includes four D-size (1.5 Volt) cells 460 positioned within a battery housing 464 having a removable cover 462. Batteries 460 are electrically connected by three dual connectors 466 to form one combined power source. Two of the three dual connectors 466 are mounted to the battery cover 462. One of the three dual connectors 466 is mounted to the battery housing 464. The combined electrical output of the four batteries 460 is accessed through a negative terminal 468 and a positive terminal 470 in battery housing 464. Wires (not shown) from terminals 468 and 470 are connected to PCB 452 via connector 458.

Battery cover 462 and housing 464 are secured together by a screw 480 and a threaded insert 482. Battery housing 464 has an aperture 472 which holds a light pipe 474 for LED 476. LED 476 emits a yellow light when the combined voltage of batteries 460 is low.

Figure 5:
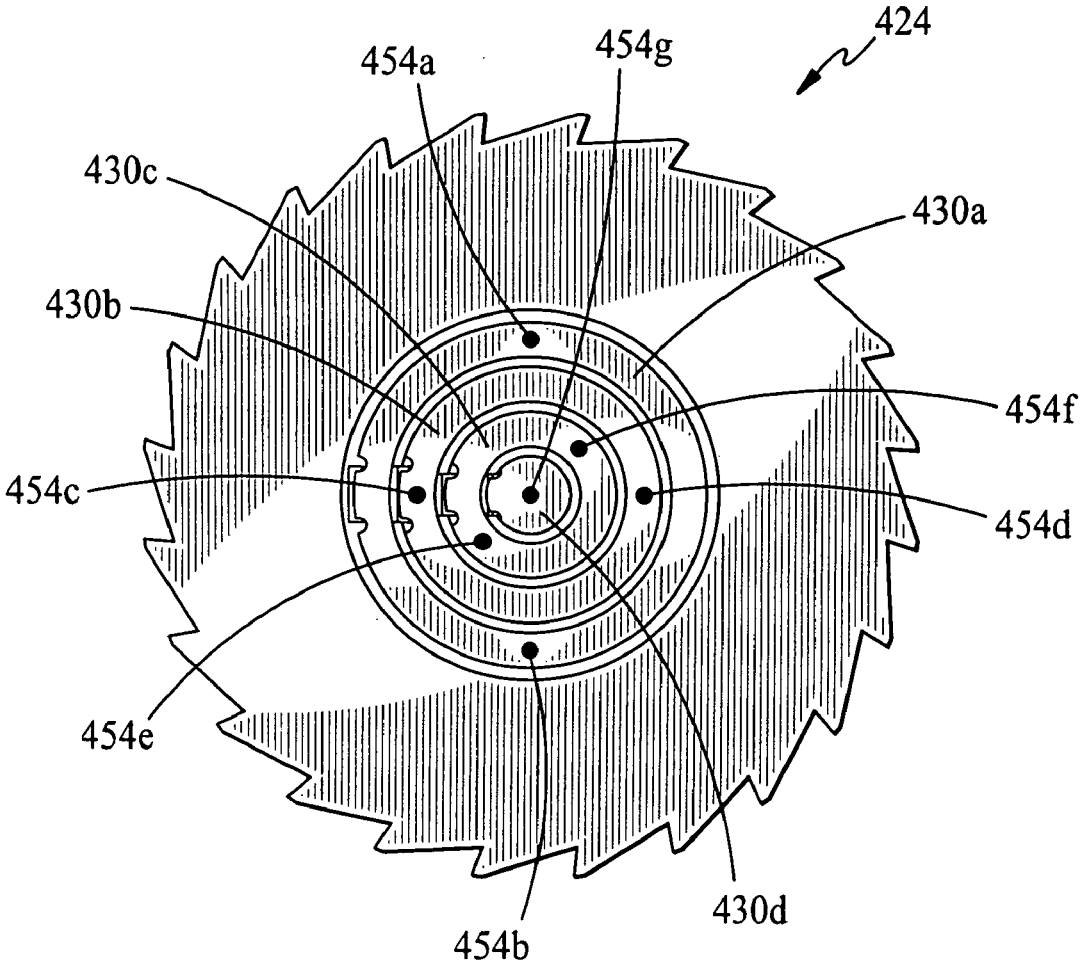
FIG. 5 is a top view of the extension stop gear of the release assembly.
Figure 6:
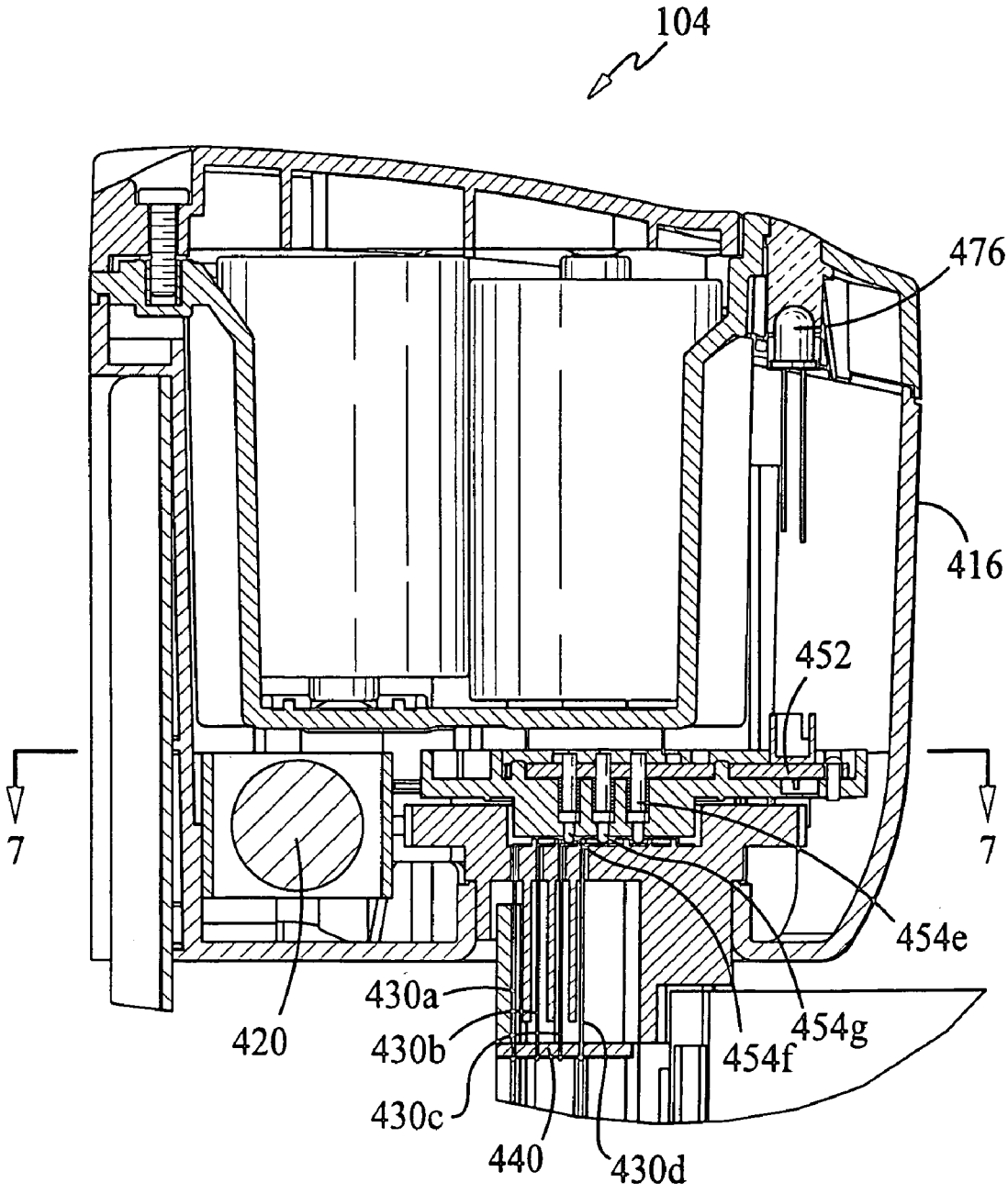
FIG. 6 is a vertical cross-sectional view of the extension release assembly.

As shown in FIG. 5, each ring contact 430*a*–430*c* makes sliding electrical contact with two different pins 454. Ring 430*a* is in contact with pins 454*a* and 454*b*, ring 430*b* is in contact with pins 454*c* and 454*d*, and ring 430*c* is in contact with pin 454*e* and 454*f*. Center contact 430*d* is in contact with pin 454*g*. Multiple pin contacts with the outer ring helps to ensure contact reliability during rotation.

Figure 7:
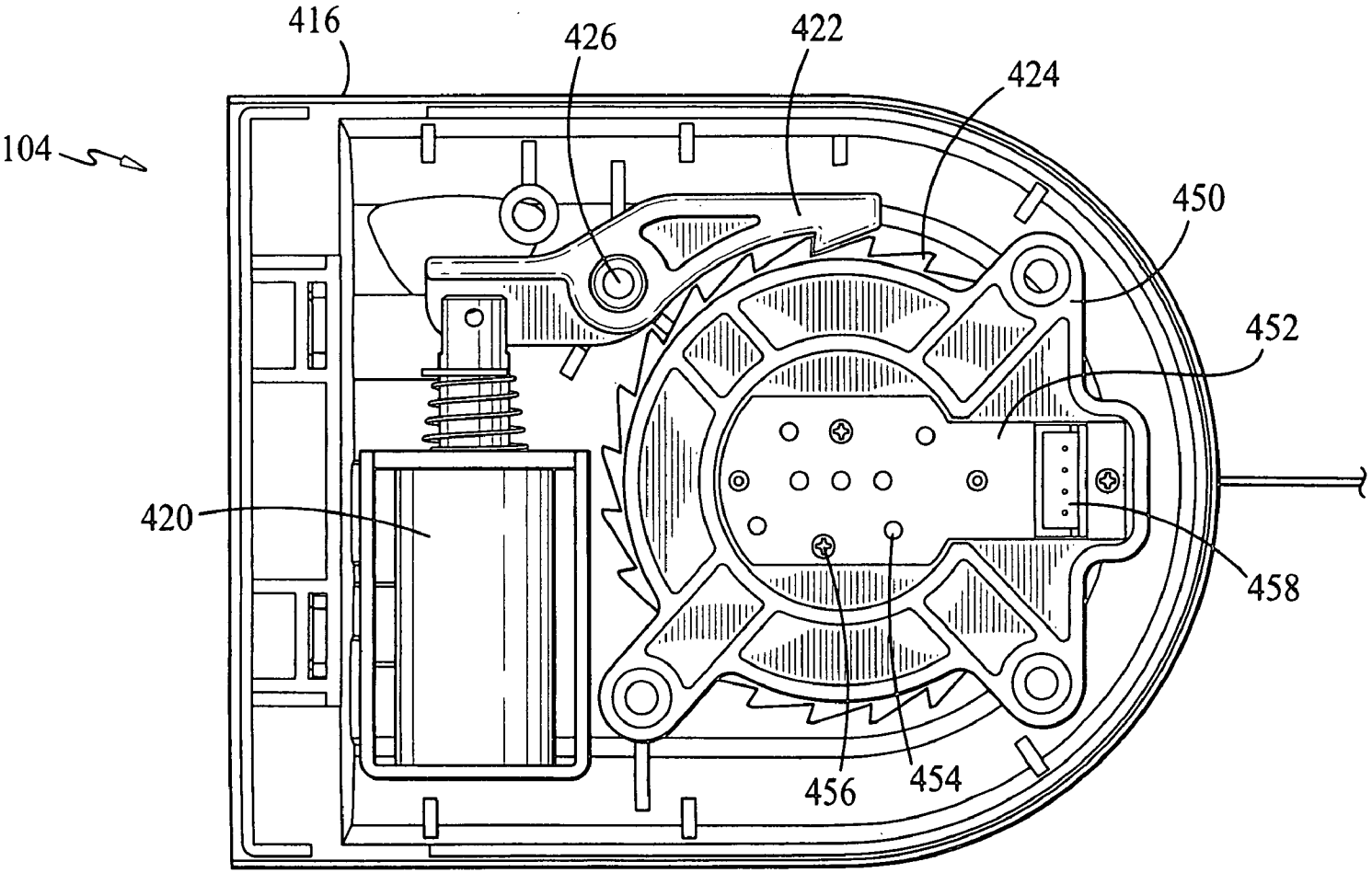
FIG. 7 is a horizontal cross-sectional view taken of the extension release assembly, taken at line 7—7 in FIG. 6.

Referring to FIG. 7, when the voltage is applied to the trigger line this voltage is transferred to solenoid 420 via PCB 452. In response to trigger voltage, the shaft of the solenoid 420 retracts to release pawl 422 from gear 424, enabling extension of the barrier by the operator.

In the absence of battery voltage, the shaft of solenoid 420 remains in its normally extended position as shown, preventing extension of the barrier 112. The barrier 112 is readily retracted by a torsion spring (not shown) within the barrier spool shaft, even when the batteries 460 are dead.

Figure 8:
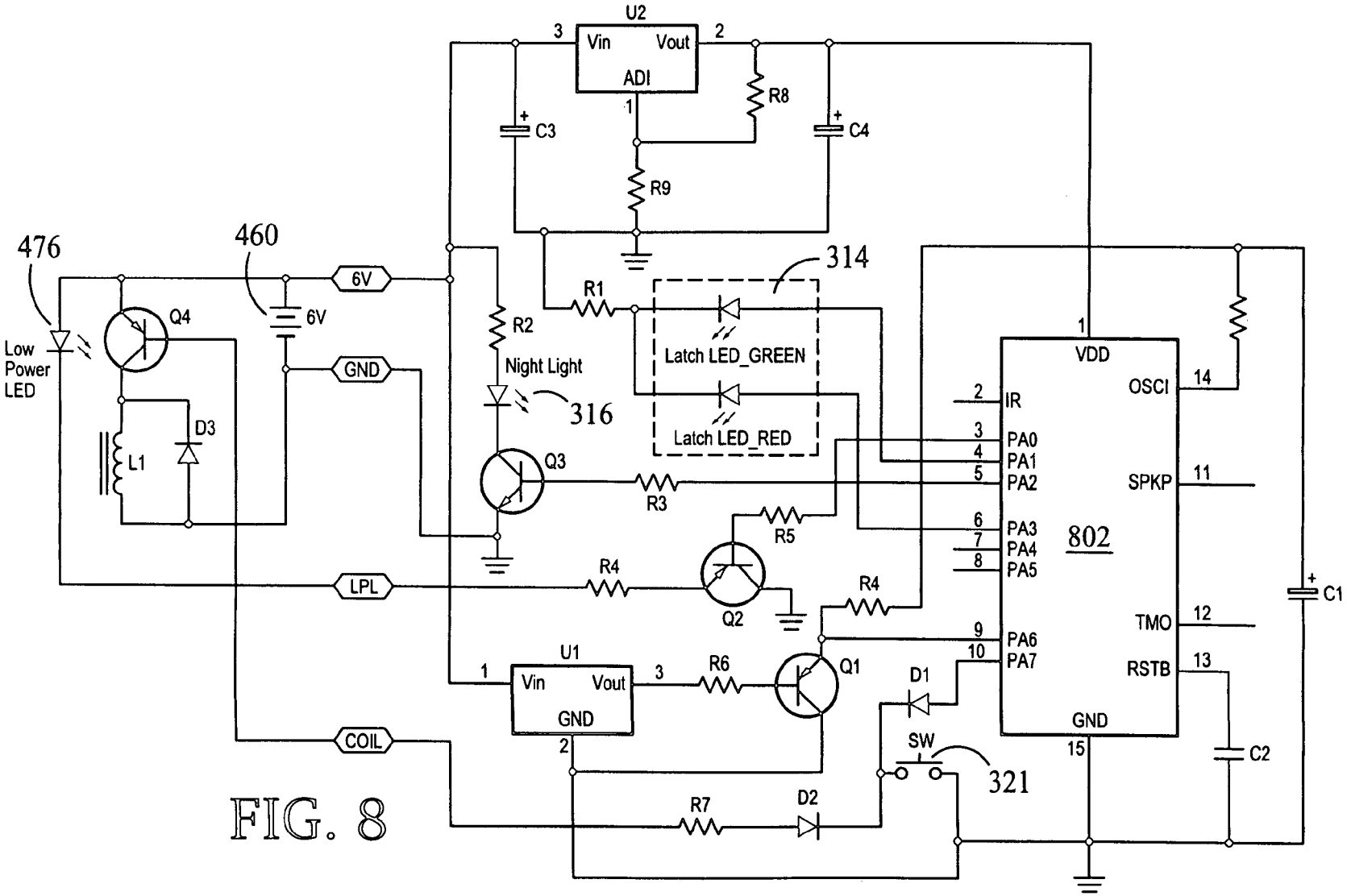
FIG. 8 illustrates an exemplary gate extension control circuit.

An electrical circuit for use in the barrier assembly is depicted in FIG. 8. Logical processing is provided by processor 802.

Other embodiments of the barrier assembly 100 include adding features that utilize the power from the batteries 460 or additional power sources as required.

Figure 9B:
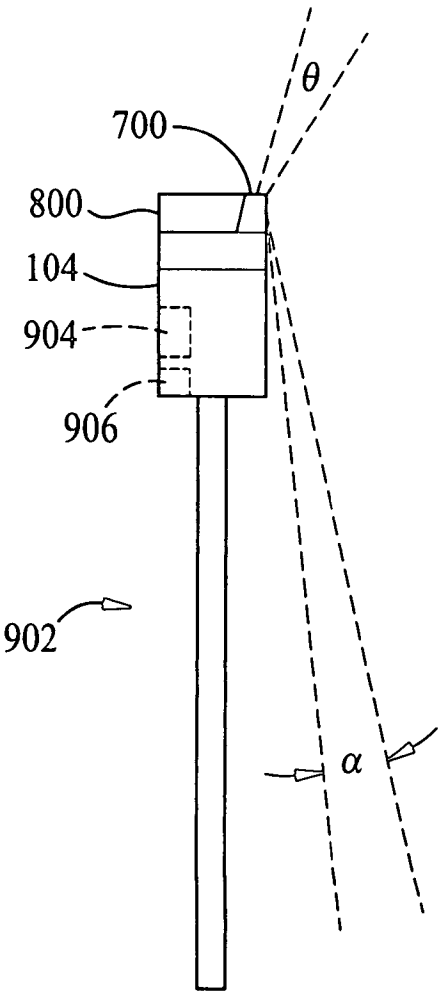
FIG. 9B is an end view of the barrier assembly of FIG. 9A.
Figure 9A:
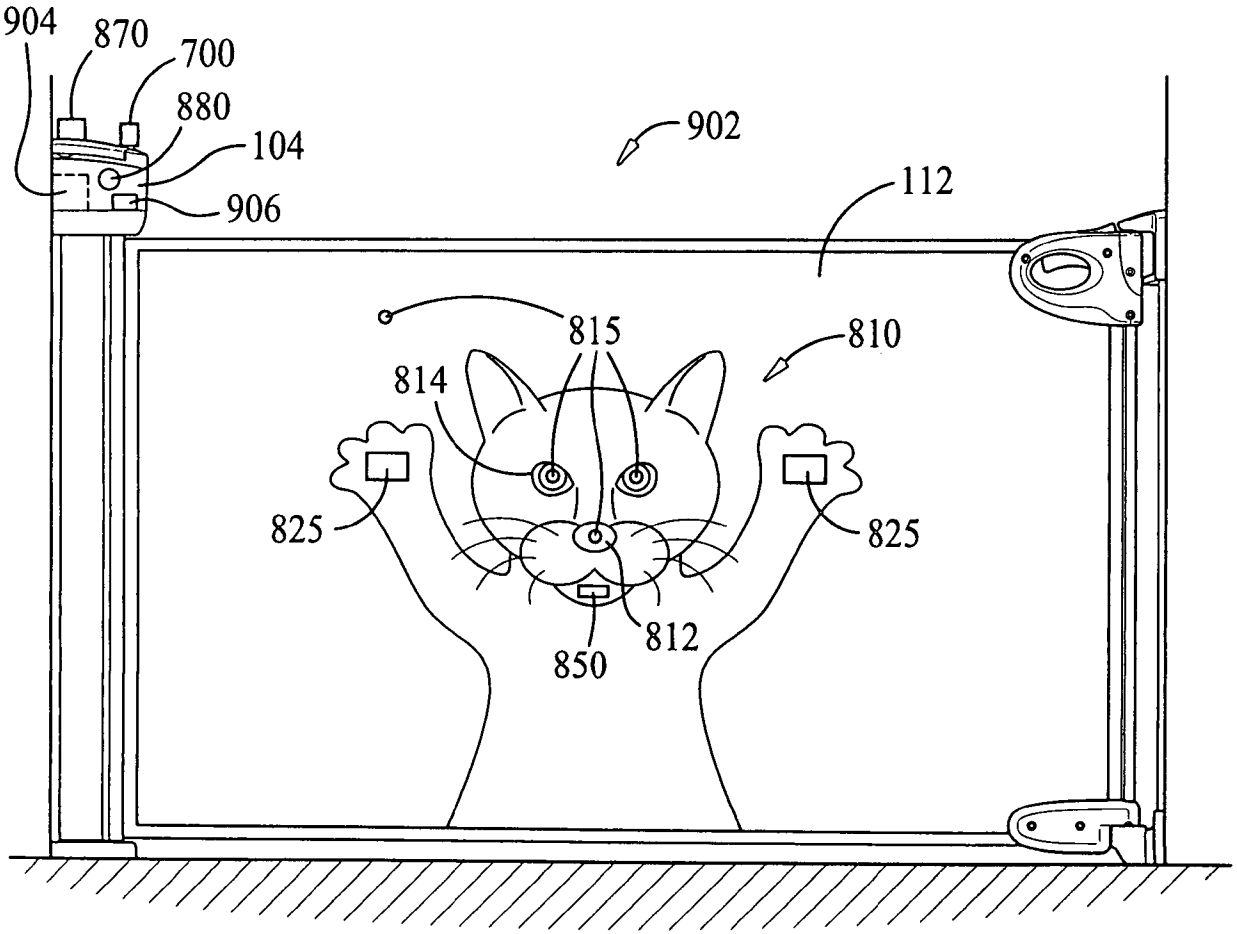
FIG. 9A is a side view of a second example of a barrier assembly, with a motion sensor.

Referring to FIGS. 9A and 9B, gate 902 includes all of the features of the above described gate plus other advanced features. A motion sensor 700 is mounted, for example, on housing 104, to sense proximate movement within an angle θ. The angle θ can be selected such that sensor 700 is responsive to a motion of an approaching or otherwise present person of average adult height for automatic unlocking of the gate. Alternatively, motion sensor 700 may be configured to be responsive to a motion within a range a for sensing a motion of an approaching or otherwise present child near the barrier 112 to, e.g., trigger an audible alarm (not shown), or to alert a parent in another location by sending a radio frequency signal from a transmitter 904 to a parent monitoring unit.

A microphone 906 and associated voice recognition processing capability, can release the extension latch in response to a recognized verbal command from an adult. The microphone can be connected to a two-way intercom for the adult to monitor the child in another part of the home. In some embodiments, barrier 104 includes a built-in audio and video unit 870 for monitoring the child's movement. A light sensor (not shown) turns on a night light 880 when ambient lighting falls to a predetermined level.

Barrier 112 depicts a cartoon character 810 on the exterior of the barrier, in a form of a cat, for example. Character 810 aids in making barrier 112 appear less threatening to a child. LEDs 815 are placed on the barrier 112 within and around cartoon character 810. For example, the LEDs 815 are placed within nose 812 and eyes 814 of cartoon character 810. In one embodiment, LEDs 815 are connected to motion sensor 700 by wires (not shown) and LEDs 815 are activated when a child's movement triggers sensor 700. In another embodiment, LEDs 815 are connected to touch pad sensors or child-activatable switches 825 by wires (not shown), such that when one or more touch pad sensors 825 are touched by a child, LEDs 815 are activated. A sound device 850 is connected to motion sensor 700 and touch pads 825. When motion sensor 700 or touch pads 825 are activated sound device 850 makes sounds. For example, the sounds can be a children's nursery rhyme or a voice from cartoon character 810. For instance, the sound could be "I am a white cat. My name is Snow." In another example (not shown), touch sensitive areas are provided on the barrier web in the shape of numbers, letters, or objects and electrically connected to a processor within the barrier housing for generating the audible name of each number, letter or object, or some other sound associated with each touch-sensitive area, as the touch sensitive areas are touched by a child. The processor can be responsive to capacitance changes in the touch-sensitive areas caused by contact with human skin. Thus, various versions of barrier assembly 902 function as an instructional or play devices as well as child safety barriers.

In various embodiments, one or more of the advanced features of gate 902 described above are combined as the application warrants. Other embodiments not described herein are also within the scope of the following claims.

What is claimed is:

1. An adjustable width child safety device comprising:

a housing mountable to a surface on one side of a passageway;

a main shaft coupled to the housing for rotation about an axis;

a flexible barrier secured to the main shaft at an inner edge of the barrier, the barrier being extendable across the passageway to inhibit passage by a child;

an electrically operable extension lock adapted to prevent extension of the barrier from the housing until electrically unlocked;

a barrier stop member coupled to the main shaft and arranged to prevent rotation of the main shaft when locked; and an electric switch disposed at a distal end of the flexible barrier, the switch operable to unlock the extension lock.

2. The device of claim 1, wherein the lock permits retraction when locked.

3. The device of claim 1, wherein the lock comprises a solenoid biased toward a locking position.

4. The device of claim 1, wherein the lock is disposed within the housing.

5. The device of claim 1, wherein the lock includes a pawl biased to inhibit rotation of the shaft, and retractable to permit shaft rotation.

6. The device of claim 1, further comprising a motion sensor located on the exterior of the device.

7. The device of claim 6, wherein the motion sensor is responsive to motion only above a predetermined height relative to the device.

8. The device of claim 7, further comprising an audible alarm triggered by the motion sensor.

9. The device of claim 7, further comprising a radio transmitter triggered by the motion sensor.

10. The device of claim 1, further comprising a microphone and adapted to release the lock in response to a recognized verbal command.

11. The device of claim 1, further comprising an intercom disposed on the housing.

12. The device of claim 1, further comprising a built in audio device.

13. The device of claim 12, further comprising a built in video device.

14. The device of claim 1, further comprising a cartoon character depicted on the exterior surface of the barrier.

15. The device of claim 1, wherein the barrier comprises:

a plurality of light emitting diodes on the exterior surface of the barrier; and a sensor electrically connected to the plurality of light emitting diodes.

16. The device of claim 15, wherein the plurality of light emitting diodes illuminate when triggered by the sensor.

17. The device of claim 16, further comprising a noise generating device electrically connected to the sensor.

18. A child safety gate releasably securable across a passageway to block passage of young children, the gate including:

a housing mountable to a surface on one side of the passageway;

a main shaft coupled to the housing for rotation about an axis;

a flexible barrier secured to the main shaft at an inner edge of the barrier, the barrier being extendable across the passageway to inhibit passage by the child;

an interactive visual display comprising:

a light electrically connected to a power source and positioned on the barrier; and a sensor electrically connected to the light, wherein the sensor is responsive to a sound of the child; and an electrically operable extension lock adapted to prevent extension of the barrier from the housing until electrically unlocked.

19. The gate of claim 18, wherein the lock permits retraction when locked.

20. The gate of claim 19, further comprising a barrier stop member coupled to the main shaft and arranged to prevent rotation of the main shaft when locked.

21. The gate of claim 20, further comprising an electric switch operable to unlock the extension lock.

22. The gate of claim 21, wherein the switch is disposed at a distal end of the flexible barrier.

23. The gate of claim 18, wherein the lock comprises a solenoid biased toward a locking position.

24. The gate of claim 18, wherein the lock is disposed within the housing.

25. The gate of claim 18, wherein the power source comprises a battery enclosed within the gate.

26. The gate of claim 18, further comprising a sensor responsive to a touch of the child.

27. The gate of claim 18, further comprising a sensor responsive to a movement of the child.

28. The gate of claim 18, further comprising a sound device connected to the sensor, the sound device producing sound when engaged by the sensor.

29. An adjustable width child safety device comprising:

a housing mountable to a surface on one side of a passageway;

a main shaft coupled to the housing for rotation about an axis;

a flexible barrier secured to the main shaft at an inner edge of the barrier, the barrier being extendable across the passageway to inhibit passage by a child;

an electrically operable extension lock adapted to prevent extension of the barrier from the housing until electrically unlocked; and a microphone, wherein the safety device releases the lock in response to a recognized verbal command.

30. The device of claim 29, wherein the lock permits retraction when locked.

31. The device of claim 29, further comprising an electric switch operable to unlock the extension lock.

32. The device of claim 29, further comprising a built in audio device.

33. An adjustable width child safety device comprising:

a housing mountable to a surface on one side of a passageway;

a main shaft coupled to the housing for rotation about an axis;

a flexible barrier secured to the main shaft at an inner edge of the barrier, the barrier being extendable across the passageway to inhibit passage by a child;

an electrically operable extension lock adapted to prevent extension of the barrier from the housing until electrically unlocked;

a built in audio device; and a built in video device.

34. An adjustable width child safety device comprising:

a housing mountable to a surface on one side of a passageway;

a main shaft coupled to the housing for rotation about an axis;

a flexible barrier secured to the main shaft at an inner edge of the barrier, the barrier being extendable across the passageway to inhibit passage by a child;

an electrically operable extension lock adapted to prevent extension of the barrier from the housing until electrically unlocked; and a barrier stop member coupled to the main shaft and arranged to prevent rotation of the main shaft when locked;

wherein the lock comprises a solenoid biased toward a locking position.

35. The device of claim 34, wherein the lock permits retraction when locked.

36. The device of claim 34, wherein the lock is disposed within the housing.

37. The device of claim 34, wherein the lock includes a pawl biased to inhibit rotation of the shaft, and retractable to permit shaft rotation.

* * * * *